US005828007A

United States Patent [19]

Fujishita et al.

[11] Patent Number: 5,828,007

[45] Date of Patent: Oct. 27, 1998

[54] WIRE

[75] Inventors: Mikio Fujishita; Hidemi Tanigawa, both of Yokkaichi, Japan

[73] Assignee: Sumitomo Wiring Systems, Ltd., Japan

[21] Appl. No.: 603,809

[22] Filed: Feb. 20, 1996

[30] Foreign Application Priority Data

Feb. 24, 1995 [JP] Japan ..... 7-036972
Feb. 24, 1995 [JP] Japan ..... 7-036974

[51] Int. Cl.[6] ..... H01B 7/00

[52] U.S. Cl. ..... 174/120 R; 174/73.1; 174/84 C

[58] Field of Search ..... 174/105 R, 107, 174/110 R, 110 V, 120 SR, 120 R, 84 C, 73.1

[56] References Cited

U.S. PATENT DOCUMENTS

| | | | |
|---|---|---|---|
| 1,982,288 | 11/1934 | Evans | 173/264 X |
| 3,219,752 | 11/1965 | Harris | 174/117 F X |
| 4,537,804 | 8/1985 | Keane et al. | 427/118 X |
| 4,665,281 | 5/1987 | Kamis | 174/102 R |
| 4,760,296 | 7/1988 | Johnston et al. | 310/45 X |
| 4,864,725 | 9/1989 | Debbaut | 29/871 X |
| 4,935,302 | 6/1990 | Hjortsberg et al. | 428/38 X |
| 4,941,729 | 7/1990 | Hardin et al. | 350/96.23 X |
| 5,192,834 | 3/1993 | Yamanishi et al. | 174/120 SR |
| 5,486,653 | 1/1996 | Dohi | 174/84 C |
| 5,552,222 | 9/1996 | Bolon et al. | 428/379 X |
| 5,563,375 | 10/1996 | Hayami | 174/120 R |

FOREIGN PATENT DOCUMENTS

| | | |
|---|---|---|
| 2134310 | 3/1972 | France . |
| 4-296406 | 2/1992 | Japan . |
| 1002525 | 8/1965 | United Kingdom . |

*Primary Examiner*—Bot L. Ledynh
*Assistant Examiner*—Chau N. Nguyen
*Attorney, Agent, or Firm*—Anthony J. Casella; Gerald E. Hespos; Ludomir A. Budzyn

[57] ABSTRACT

In order to radiate heat so that a wire does not experience smoking before a fuse blows out, a wire 10 is formed by covering a core 13 made of conductive wires with an insulation sheath 12. The insulation sheath 12 is made of a radiating insulation material having a high thermal conductivity obtained by mixing one or more of silica, alumina, magnesium oxide, boron nitride and beryllium oxide with poly vinyl chloride.

9 Claims, 3 Drawing Sheets

WIRE

BACKGROUND OF THE INVENTION

1. Field of the Invention

The present invention relates to a wire having an improved radiation performance and is particularly designed to improve a radiation performance of a wire in which a large current flows, such as a wire connecting a battery and a motor, so as to prevent smoking or other problems caused by excessive heating of the wire before a fuse blows out.

2. Description of the Prior Art

A known wire used for wiring harnesses of an automatic vehicle is generally formed by covering a core made of braided wires or a single wire with an insulation sheath of insulating resin containing poly vinyl chloride (PVC) as a main component.

Poly vinyl chloride forming the insulation sheath has a radiation performance. A fuse is provided in a circuit which is connected with a power source and a load in which a large current flows. The fuse blows out before smoking or other problem caused by excessive heating of the cable occurs, thereby disconnecting the circuit.

However, when a large amount of current flows through the core, heat is generated in the core and transmitted to the insulation sheath. Consequently, the temperature thereof gradually increases and, eventually, smoking may occur before the connected fuse blows out.

For example, in a circuit as shown in FIG. 5, a battery 1 and a fuse 2 are connected via a wire W1 and the fuse 2 and a motor 3 is connected via a wire W2. The fuse 2 is of 40A. The blowout characteristic of the fuse 2 is set as indicated by a curve A in FIG. 6. More specifically, the fuse 2 blows out if a current of 110A continuously flows for 10 seconds, a current of 90A continuously flows for 26 seconds, or a current of 50A continuously flows for 400 seconds to go above the curve A.

A curve B in FIG. 6 represents where a wire of 2 sq (diameter of its core: 2 mm) experiences smoking at an ambient temperature of 25° C. In a hatched region where the curve B is below the curve A, the wire experiences smoking before the fuse 2 blows out. For example, even if a current of 70A continuously flows for 50 seconds, the fuse 2 does not blow out, but the wire experiences smoking.

On the contrary, a wire of 3 sq has a core of a larger diameter. Since an electrical resistance of the wire of 3 sq during application of current is smaller because of its larger diameter, generation of heat is suppressed in this wire. A curve C in FIG. 6 represents where the wire of 3 sq experiences smoking at an ambient temperature of 25° C. Because the curve C is always above the curve A, the fuse 2 invariably blows out before the wire experiences smoking. Therefore, the use of the wire of 3 sq eliminates the probability of the smoking of the wire before the blowout of the fuse 2.

However, because the core of the wire of 3 sq has a larger diameter, the diameter of the wire of 3 sq itself is large. Accordingly, the use of the wire of 3 sq leads to a larger wiring space and a heavier weight. Since a multitude of wiring harnesses are used for an automotive vehicle, the total weight of the wiring harnesses considerably increases when the wire of 3 sq is used.

Generally, wires of 2 sq and 3 sq are defined as shown in TABLE-1 when the cores are made by braiding soft copper wires.

TABLE 1

| | A | B | C | D |
|---|---|---|---|---|
| 2sq | 26 | 0.32 mm | 1.9 mm | 0.5 mm |
| 3sq | 41 | 0.32 mm | 2.4 mm | 0.6 mm |

A: Number of Braided Wires to Form a Core
B: Diameter of Braided Wires
C: Diameter of the Core
D: Thickness of an Insulation sheath Therefore, it is an object of the present invention to provide a wire having an improved performance, in particular without a likelihood that the wire experiences smoking before the blowout of a fuse even if a narrower wire such as a wire of 2 sq is used.

SUMMARY OF THE INVENTION

According to the invention, there is provided a wire comprising at least one core and a heat removing layer, in particular a heat radiating layer being formed of a material having a high thermal conductivity obtained by mixing one or more of silica, alumina, magnesium oxide, boron nitride and beryllium oxide with poly vinyl chloride. The heat is moved, in particular by heat-radiation, by transfer to other elements or the environment or by convection.

According to a preferred embodiment, the material having a high thermal conductivity comprises from below 90 percent by weight (weight %) preferably about 40 to about 80 weight % of one or more of silica, alumina, magnesium oxide, boron nitride and beryllium oxide, the remainder being poly vinyl chloride.

Preferably, the heat removing layer, in particular heat radiating layer forms an insulating sheath of the wire at least along one or more axial portions thereof.

Further preferably, the material having a high thermal conductivity comprises about 50 weight % of one or more of silica, alumina, magnesium oxide, boron nitride and beryllium oxide, the remainder being poly vinyl chloride.

Further preferably, the heat removing layer, in particular heat radiating layer has a thickness from about 0.2 mm to 1.5 mm, preferably from about 0.5 mm to about 1 mm.

According to a further preferred embodiment of the invention, the heat removing layer, in particular heat radiating layer comprises a removing coating, in particular a radiation coating, being arranged at a radially outward position of an insulating sheath of the wire.

Preferably, the removing coating, in particular radiation coating is in contact with the insulating sheath.

Further preferably, the material having a high thermal conductivity comprises about 80 weight % of one or more of silica, alumina, magnesium oxide, boron nitride and beryllium oxide, the remainder being poly vinyl chloride.

Further preferably, the heat removing layer, in particular heat radiating layer has been heated to adhere to the core or to the insulating sheath.

Further preferably, the removing coating, in particular radiation coating has a tubular or sheetlike configuration, wherein the heat removing layer, in particular heat radiating layer is preferably provided in the proximity of a connector or terminal fitting provided at an end of the wire.

According to a still further preferred embodiment, the core is formed by at least two core conductors and wherein the heat removing layer, in particular heat radiating layer penetrates into the space between the at least two core conductors at least partially.

Further preferably, the heat removing layer, in particular heat radiating layer is secured by adhesive means and/or cramping means.

According to a preferred embodiment of the invention, there is provided a radiation cable formed by covering a core made of conductive wire(s) with an insulation sheath, wherein the insulation sheath is made of a radiating insulation material having a high thermal conductivity obtained by mixing one or more of silica, alumina, magnesium oxide, boron nitride and beryllium oxide with poly vinyl chloride.

Accordingly, even if heat is generated in the insulation sheath due to a flow of current through the core, the heat is efficiently radiated without remaining in the insulation sheath because the insulation sheath is made of the radiating insulation material and, accordingly, has a better radiation performance. Therefore, the temperature of the insulation sheath does not increase and the smoking of the wire before the blowout of the fuse connected therewith can be prevented.

As is clear from the above description, the wire according to a preferred embodiment of the invention is capable of efficiently radiating the heat in the insulation sheath because the insulation sheath is made of a radiating insulation material having a high thermal conductivity. Accordingly, the smoking of the wire caused by excessive heating can be delayed and, therefore, the fuse blows out before smoking occurs. In other words, the smoking of the wire is prevented. Further, since smoking is prevented without increasing the diameter of the wire, this wire does not meet problems such as an increased weight and an increased wiring space which generally arise when the diameter of the wire is increased. Furthermore, a wire can be produced more inexpensively than a wire having a larger diameter.

A preferable mixing ratio of poly vinyl chloride to the substance(s) to be mixed is for the above embodiment 50 to 50 weight %.

In the above embodiment, the thickness of the insulation sheath made of the radiating insulation material is same as that of the prior art.

According to a further preferred embodiment, there is provided a wire comprising a radiation coating having an insulation property and a high thermal conductivity and made of a mixture obtained by mixing one or more of silica, alumina, magnesium oxide, boron nitride and beryllium oxide with poly vinyl chloride, wherein the radiation coating is mounted around an insulated wire having a core which is exposed by peeling off an insulation sheath thereof and is to be connected with a terminal fitting, such that the radiation coating closely covers the outer surface of the insulation sheath in the proximity to the terminal fitting.

A preferable mixing ratio of poly vinyl chloride to the substance(s) to be mixed is 20 to 80 weight %. Poly vinyl chloride is used as filler for the other substances having a high thermal conductivity.

Accordingly, the radiation coating is mounted in contact with the insulation sheath in the position near the connected portion of the terminal fitting and the core where heat is generated at most. Accordingly, the heat generated in the connected portion is transferred from the insulation sheath of the wire to the radiation coating and is radiated to the outside. Therefore, a temperature increase of the insulation sheath can be suppressed and the smoking of the wire before the blowout of a fuse connected with the wire can be prevented.

As is clear from the above description, the radiation coating is mounted in contact with the insulation sheath in the position near the connected portion of the terminal fitting and the core where heat is generated at most. Accordingly, the heat generated in the connected portion can be efficiently radiated. Therefore, the smoking caused by excessive heating can be delayed and the fuse blows out during a delayed period. As a result, the smoking of the wire can be prevented. Particularly, since the smoking is prevented without increasing the diameter of the wire by mounting the radiation coating at the portion of the wire which is likely to be excessively heated, problems caused by the increased diameter of the wire such as an increased weight and an increased wiring space do not arise. Further, the wire covered with the radiation coating can be less expensively produced than the wire having a larger diameter.

Preferably, the radiation coating has a tubular or sheetlike shape, and covers the outer surface of the insulation sheath of the wire.

Preferably, the radiation coating is in close contact with the outer surface of the insulation sheath so that no air remains between the radiation coating and the insulation sheath.

The thickness of the radiation coating is preferably 0.5 mm to 1.0 mm. The tubular radiation coating may be widened to be fitted around the wire. Alternatively, the sheetlike radiation coating may be mounted around the wire and its end may be fastened with adhesive.

Accordingly, the radiation coating having a tubular or sheetlike shape can be easily mounted around the wire. Preferably, a connection terminal or a cramping terminal is connected with the wire after the radiation coating is mounted around the wire.

If the radiation coating has a tubular shape, it can be mounted only by being fitted over the wire, requiring less labor. If the radiation coating has a sheetlike shape, it can be used independently of the diameter of the wire.

According to a further preferred embodiment, the radiation coating may preferably be heated to adhere to the outer surface of the insulation sheath of the wire. In this way, the radiation coating and the insulation sheath can be better sealed.

If heating is applied to the radiation coating mounted around the wire so that the radiation coating is in close contact with the insulation sheath, the heat in the insulation sheath can be rapidly and securely transferred to the radiation coating, thereby realizing an efficient radiation.

Thus, if heating is applied to the radiation coating mounted around the wire so that the radiation coating is in close contact with the insulation sheath, the insulation sheath of the wire and the radiation coating can be securely sealed, thereby permitting heat to be securely transferred to the radiation coating. As a result, radiation of the wire can be efficiently realized.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENT

Hereafter, one embodiment of the invention is described with reference to the accompanying drawings.

Figure 1A:
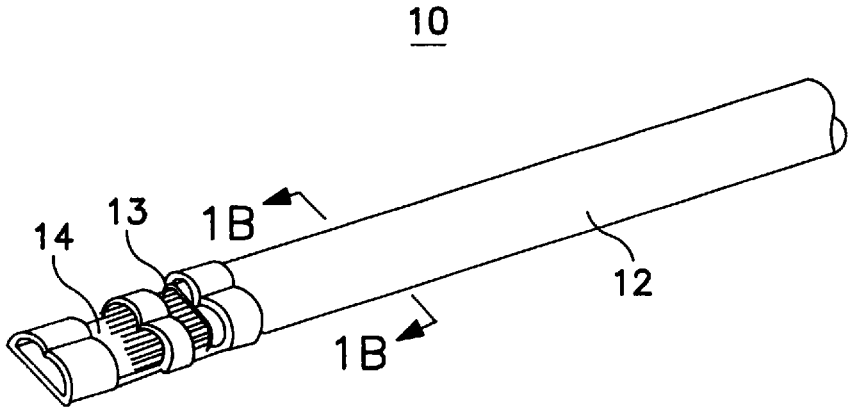
FIG. 1(A) is a perspective view of a wire according to one embodiment of the invention.
Figure 1B:
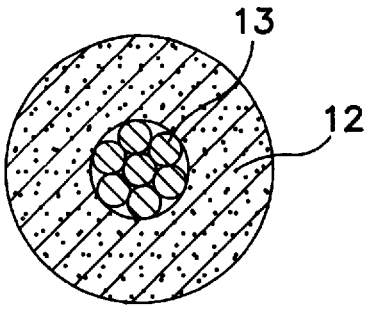
FIG. 1(B) is a section taken along 1(B)—1(B) of FIG. 1(A).

FIGS. 1(A) and 1(B) show a wire 10 according to the invention. A core 13 of 2 sq is covered with an insulation sheath 12 of a radiating insulation material which is obtained by mixing 60 weight % of poly vinyl chloride and 40 weight % of a mixture of silica, alumina and beryllium oxide.

As described above, only one of silica, alumina, magnesium oxide, boron nitride, beryllium oxide may be used or two or more of the above may be suitably selected and mixed.

The thermal conductivities of the substances to be mixed are as shown in TABLE-2 below.

TABLE 2

| SUBSTANCE | THERMAL CONDUCTIVITY [cal/(cm · s · deg)] | [W/(m · K)] |
|---|---|---|
| SILICA | $3.7 \times 10^{-3}$ | $3.7 \times 10^{-1}$ |
| ALUMINA | $7.0 \times 10^{-2}$ | 7.0 |
| MAGNESIUM OXIDE | $8.6 \times 10^{-2}$ | 8.6 |
| BORON NITRIDE | $1.5 \times 10^{-1}$ | 15 |
| BERYLLIUM OXIDE | $5.6 \times 10^{-1}$ | 56 |

Figure 3:
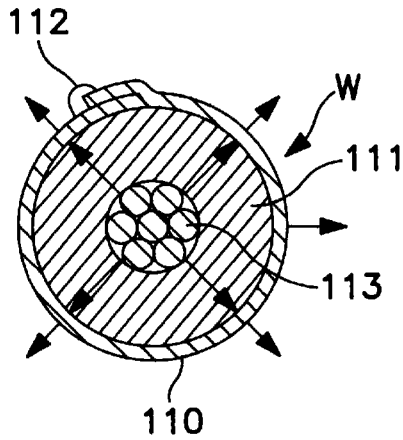
FIG. 3 is a section showing how heat propagates in the wire of the further embodiment.

The wire 10 is, for example, used to connect the battery 1 and the fuse 2, and the fuse 2 and the motor 3 as in the prior art shown in FIG. 3. Portions of the wires 10 to be connected with the battery 1, the fuse 2 and the motor 3 have their insulation sheaths 12 peeled off at their ends to expose the cores 13. A cramping terminal 14 is connected with each exposed core 13.

With the insulation sheath 12 made of the radiating insulation material as described above, even if a current flows through the core 13 of the wire 10 to generate heat in the insulation sheath 12, heat in the insulation sheath 12 is efficiently radiated because of a good thermal conductivity of the insulation sheath 12, thereby suppressing a temperature increase of the insulation sheath 12. As a result, the smoking of the wire 10 due to the temperature increase of the insulation sheath 12 can be delayed.

Figure 4:
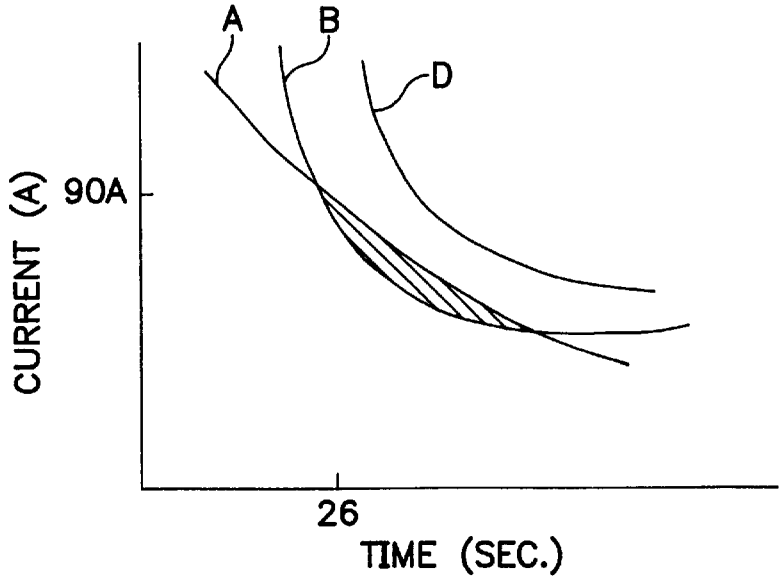
FIG. 4 is a graph showing smoking curves of a wire of the different embodiments and of a prior art wire and a blowout characteristic curve of a fuse.

A curve D in FIG. 4 represents where the wire 10 of 2 sq according to this embodiment experiences smoking. This smoking curve D is above the smoking curve B of the prior art wire W of 2 sq and the blowout curve A of the fuse 2 of 40A. Therefore, the smoking of the wire before the blowout of the fuse 2 can be constantly prevented.

Figure 1C:
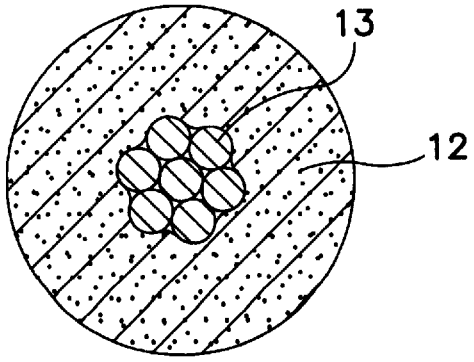
FIG. 1(C) is an alternative cross section of the wire of the present invention wherein the heat removing layer penetrates at least partially into the spaces between core conductors.

FIG. 1(C) is an alternative cross section of the wire of the present invention wherein the heat removing layer penetrates at least partially into the spaces between core conductors.

Figure 2:
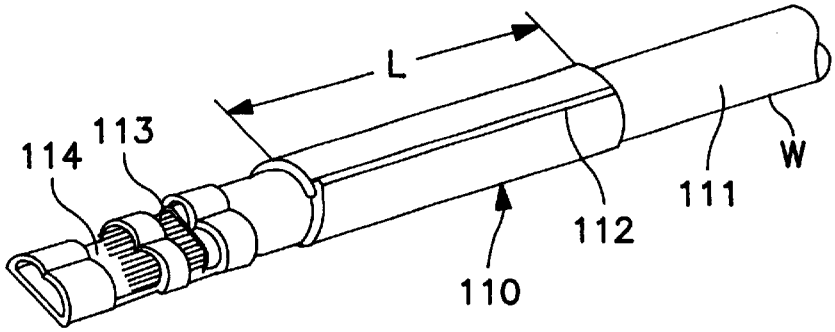
FIG. 2 is a perspective view of a wire according to a further embodiment of the invention.

FIG. 2 shows a wire W covered with a sheetlike radiation coating 110. The radiation coating 110 is formed by making a sheet having a thickness of 0.5 mm from a material obtained by mixing 20 weight % of poly vinyl chloride with 80 weight % of a mixture of silica, alumina and beryllium oxide and by cutting the sheet to have a length L of approximately 100 mm.

The cut sheet has a narrow rectangular shape and is mounted around the entire outer surface of an insulation sheath 111 of the wire W in close contact therewith near a position where a terminal is to be mounted at the wire W. An end of the radiation coating 110 is fastened with an adhesive 112. The insulation sheath 111 of the wire W is made of a known material containing poly vinyl chloride as a main component and covers a core 113. The wire W is of the aforementioned 2 sq. A cramping terminal 114 is connected at the end of the wire W after the radiation coating 110 is mounted around the wire W.

Figure 5:
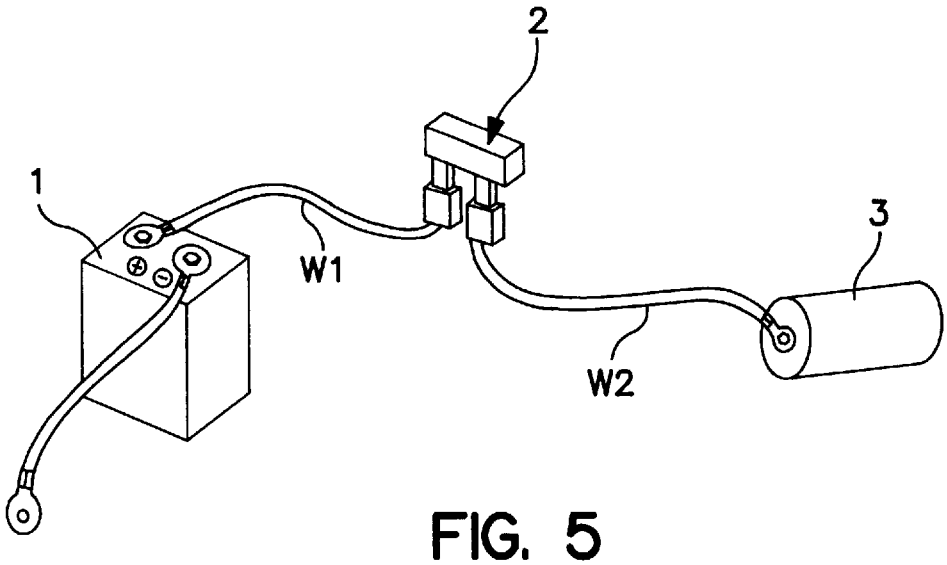
FIG. 5 PRIOR ART
FIG. 5 is a perspective view showing a portion of a circuit where wires are liable to smoke due to an excessive current flow.
Figure 6:
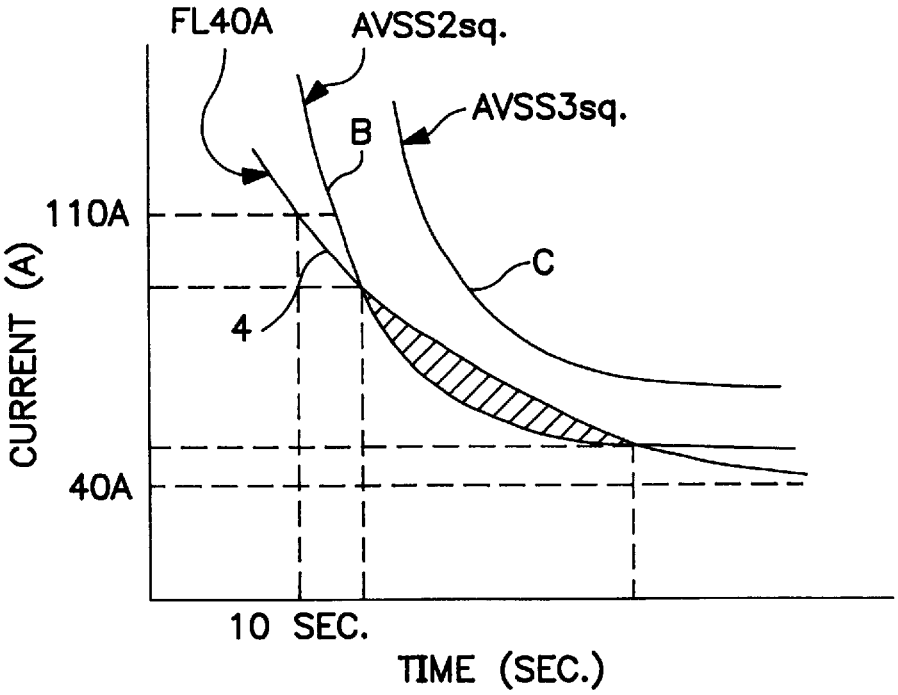
FIG. 6 PRIOR ART
FIG. 6 is a graph showing a relationship between a blowout characteristic of the fuse and smoking characteristics of prior art wires.

The radiation coating 110 is mounted, for example, around the wires W1 and W2 connecting the battery 1 and the fuse 2, the fuse 2 and the motor 3, respectively as shown in FIG. 5. Preferably, the radiation coating 110 is mounted around the portions of the wires W1 and W2 where the connection terminal fittings are to be mounted.

Although the radiation coating has a sheetlike shape and is mounted around the wire in the foregoing embodiment, it may have a tubular shape and may be fitted over the wire. Further, heating may be applied to the sheetlike or tubular radiation coating after it is mounted around the wire so that it is adhered to the outer surface of the insulation sheath of the wire.

If the wire W is covered with the radiation coating 110 as described above, upon generation of heat in the insulation sheath 111 due to a current flow through the core 113 of the wire W, the heat in the insulation sheath 111 is transferred to the radiation coating 110 having a good thermal conductivity as indicated by arrows in FIG. 3. More specifically, the heat which would have been kept in the insulation sheath in the prior art would be transferred to the outer radiation coating 110 and be radiated to the outside through the radiation coating 110, thereby suppressing a temperature increase of the insulation sheath 111. As a result, the smoking of the wire W caused by the temperature increase of the insulation sheath 111 can be delayed.

More specifically, as shown in FIG. 4, when the radiation coating 110 is mounted around the wire W of 2 sq, the smoking curve of the wire W shifts from B to D. Since the curve D is always above the curve B and the blowout characteristic curve A of the fuse 2 of 40A, the smoking of the wire W does not occur before the blowout of the fuse 2.

What is claimed is:

1. A wire for carrying high current levels without emitting smoke, said wire having opposed first and second ends and consisting essentially of: at least one core (113); an insulating sheath (111) consisting essentially of polyvinyl chloride surrounding said core (113), said insulating sheath (111) having an outer circumferential surface, a portion of said insulating sheath (111) adjacent said first end of said wire being removed for exposing said core (113); a terminal fitting (114) being secured at least to said core (113) at said first end of said wire; and a heat removing layer (110) covering and engaging portions of said outer circumferential surface of said insulating sheath (111) and extending from a first location in proximity to said terminal fitting (114) to a second location spaced from said second end of said wire, said heat removing layer (110) consisting essentially of polyvinyl chloride and a thermally conductive material selected from the group consisting of silica, alumina, magnesium oxide, boron nitride, beryllium oxide and mixtures of two or more thereof such that said heat removing layer (110) has a higher thermal conductivity than the insulating sheath (111), whereby heat from said core (113) is radiated to surrounding environments and away from said insulating sheath (111) by the heat removing layer (110) to prevent smoking of said wire in response to high current flows.

2. A wire according to claim 1, wherein the heat removing layer (110) comprises below 90 weight % of the thermally conductive material.

3. A wiring according to claim 2, wherein the heat removing layer comprises about 80 weight % of the thermally conductive material.

4. A wire according to claim 1, wherein the heat removing layer (110) has a thickness from about 0.2 mm to about 1.5 mm.

5. A wire according to claim 1, wherein the heat removing layer (110) has a tubular configuration and is adhered to the outer circumferential surface of said insulating sheath (111).

6. A wire according to claim 1, wherein the heat removing layer (110) has been heated to adhere to said portions of said outer circumferential surface of said insulating sheath (111) of the wire inwardly therefrom.

7. A wiring according to claim 1, wherein the heat removing layer (110) is formed from a substantially rectangular sheath wrapped around said outer circumferential surface of said insulating sheath (111) such that opposed parallel edges of said heat removing layer (110) are in overlapping relationship with one another and are secured by adhesive (112).

8. A wire according to claim 1, wherein the heat removing layer (110) extends along the outer circumferential surface of said insulating sheath (111) for a distance of approximately 100 mm.

9. An automotive wire for connecting an automotive battery to a fuse and for carrying fuse-blowing current levels without emitting smoke, said wire having opposed first and second ends and consisting essentially of:

a core (113) formed from a plurality of braided wires;

an insulating sheath (111) consisting essentially of polyvinyl chloride surrounding said core (113), said insulating sheath (111) having an outer circumferential surface, a portion of said insulating sheath (111) adjacent said first end of said wire being removed for exposing said core (113);

a terminal fitting (114) being secured at least to said core (113) at said first end of said wire; and a heating removing layer (110) secured in surrounding engagement with said outer circumferential surface of said insulating sheath (111) and extending approximately 100 mm from a first location in proximity to said terminal fitting (114) to a second location between said first and second ends of said wire, said heat removing layer (110) consisting essentially of polyvinyl chloride and approximately 80 weight % of a thermally conductive material selected from the group consisting of silica, alumina, magnesium oxide, boron nitride, beryllium oxide and mixtures of two or more thereof, said heat removing layer (110) having a thickness of approximately 0.5 mm, whereby heat from said core (113) is radiated into surrounding environments and away from said insulating sheath (111) by the heat removing layer (110) to prevent smoking of the wire prior to blowing of the fuse in response to high current flows.

* * * * *